US010103472B2

(12) United States Patent
Caballero et al.

(10) Patent No.: US 10,103,472 B2
(45) Date of Patent: Oct. 16, 2018

(54) AUTOMOTIVE ELECTRICAL WIRING CONNECTOR

(71) Applicant: FICO MIRRORS, S.A., Barcelona (ES)

(72) Inventors: Moises Caballero, Barcelona (ES); Raphael Michel Remaud, Migne-Auxances (FR)

(73) Assignee: Fico Mirrors, S. A., Barcelona (ES)

( * ) Notice: Subject to any disclaimer, the term of this patent is extended or adjusted under 35 U.S.C. 154(b) by 0 days.

(21) Appl. No.: 15/110,935

(22) PCT Filed: Jan. 13, 2015

(86) PCT No.: PCT/EP2015/050461
§ 371 (c)(1),
(2) Date: Jul. 11, 2016

(87) PCT Pub. No.: WO2015/107034
PCT Pub. Date: Jul. 23, 2015

(65) Prior Publication Data

US 2017/0214167 A1 Jul. 27, 2017

(30) Foreign Application Priority Data

Jan. 14, 2014 (EP) ..... 14151086

(51) Int. Cl.
*H01R 13/436* (2006.01)
*H01R 13/447* (2006.01)
(Continued)

(52) U.S. Cl.
CPC ..... *H01R 13/4362* (2013.01); *H01R 13/447* (2013.01); *H01R 13/501* (2013.01); *H01R 13/743* (2013.01); *H01R 13/745* (2013.01)

(58) Field of Classification Search
CPC ..... H01R 13/4632; H01R 13/447; H01R 13/501; H01R 13/741
(Continued)

(56) References Cited

U.S. PATENT DOCUMENTS 5,549,490 A * 8/1996 Buetas ..... H01R 13/514 439/721
6,419,368 B1 7/2002 Guttenburger et al.
(Continued)

FOREIGN PATENT DOCUMENTS

DE 202008004542 9/2008
EP 0584444 3/1994
(Continued)

OTHER PUBLICATIONS

PCT/EP2015/050461 International Search Report (5 pages).
(Continued)

*Primary Examiner* — Alexander Gilman
(74) *Attorney, Agent, or Firm* — Squire Patton Boggs (US) LLP

(57) ABSTRACT

An automotive electrical wiring connector for being inserted through a interior of a hollow shaft. It comprises a body having at least one receiving portion for an electrical conductor end that is adapted for being connected to another electrical conductor end, and a lid for covering the electrical conductor receiving portion. The lid is suitable to be in at least one operating position in which the lid is closed to the body and retaining the at least one electrical conductor therein while retaining the connector body through the interior of the hollow shaft, and in at least one non-operating position in which the lid is open for allowing the at least one electrical conductor to be accessed and released.

7 Claims, 1 Drawing Sheet

(51) Int. Cl.
*H01R 13/50* (2006.01)
*H01R 13/74* (2006.01)

(58) Field of Classification Search
USPC ..... 439/144
See application file for complete search history.

(56) References Cited

U.S. PATENT DOCUMENTS

2005/0118867 A1 6/2005 Mumper et al.
2008/0227325 A1* 9/2008 Natter ..... H01R 13/4361 439/345
2009/0269963 A1* 10/2009 Brown ..... H01R 13/4223 439/357
2013/0210260 A1* 8/2013 Boemmel ..... H01R 13/4361 439/357
2014/0170885 A1* 6/2014 Endo ..... H01R 13/506 439/345
2016/0013574 A1* 1/2016 Leonhardt ..... H01R 13/436 439/660

FOREIGN PATENT DOCUMENTS

EP 1176670 1/2002
EP 2744049 A1 6/2014
ES 262760 U 12/1981
WO WO 9907037 2/1999
WO WO2014160995 A1 10/2014

OTHER PUBLICATIONS

PCT/EP2015/050461 International Written Opinion of the International Searching Authority (6 pages).
PCT/EP2015/050461 Third Party Observation (3 pages).
PCT/EP2015/050461 Additional Comments—Third Party Observation (3 pages).

* cited by examiner

AUTOMOTIVE ELECTRICAL WIRING CONNECTOR

BACKGROUND

Technical Field

Connectors for electrically connecting electrical systems of a motor vehicle are known in the art. In motor vehicles, connectors are required to be adapted to pass through small openings such as through a hollow shaft while being retained once a given position has been reached.

In many cases, standard connectors are not capable of being passed through a standard hollow shaft. They should be designed for this purpose without adversely affecting the functionality of the connector.

In this regard, solutions have been proposed in the prior art. For example, document DE202008004542 discloses a connector for electrically connecting an electrical system of a motor vehicle and a mirror unit. The connector comprises at least three connecting elements divided into at least two plug segments. The plug segments may be arranged in different configurations in which dimensions are different in order to allow the connector to be passed through a hollow shaft. Said different configurations of the plug segments may be obtained by having the plug segments pivotable to each other.

However, this solution involving the use of pivotable plug segments renders the connector complex and requires a great deal of modification to the connector.

SUMMARY

An automotive electrical wiring connector is disclosed. The connector is simple to insert through an interior of a hollow shaft, and effective as it can keep a standard connection configuration.

The present connector comprises a body having at least one receiving portion for receiving an electrical conductor end of a cable. There might be for example three receiving portions for three cables. The electrical conductor end of the cable is intended to be connected to corresponding electrical conductor ends of other cables.

The body of the present connector comprises a lid for covering the electrical conductor receiving portion. The lid may be hinged to the connector body.

The lid is suitable for use in several positions:

- at least one operating position in which the lid is closed to the body. In this operating position, the lid itself retains the at least one electrical conductor therein and in turn it also retains the connector body through an interior of the hollow shaft; and
- at least one non-operating position in which the lid is open. In this non-operating position, the lid itself allows the at least one electrical conductor to be accessed and released.

In some embodiments of the present connector, the lid may be suitable for use at least in a third additional position:

- at least one intermediate position. In such intermediate position, the lid substantially protrudes from the body such that it retains the at least one electrical conductor therein and is capable of being flexed when passing through the interior of the hollow shaft.

The body of the connector may further comprise at least one lateral elastic leg, such as for example two, arranged at opposite sides of the body. Such at least one lateral elastic leg may have an inclined portion suitable for facilitating insertion of the connector body into the interior of the hollow shaft.

It is preferred that the body of the lid includes at least one flange. Said flange is adapted to be coupled to a coupling portion of the connector body in order to retain the lid in the above mentioned operating position or in the above mentioned intermediate position.

Said coupling portion may comprise a body provided with at least two projections. Such projections project outwards into at least one corresponding hollow portion formed in the flange for defining said lid operating and intermediate positions.

In some embodiments of the connector, the lid may include an inner retaining portion. Said inner retaining portion may protrude inwards for retaining the at least one electrical conductor fitted therein in at least one of the above mentioned lid operating position and lid intermediate position. In addition, the lid may include an outer retaining portion. Said outer retaining portion may protrude outwards for retaining the connector body in at least one of the above mentioned lid operating position and lid intermediate position.

The above described connector is efficient for insertion through an interior of a hollow shaft, and effective as it can keep the standard connection configuration. The connector dimensions and its alignment on the connection area are not affected because the connector body does not require structural modifications. In use, the above described connector is easy to fit and insert, and it has been shown to provide improved safety as the lid provides extra retention, both for the connector body and the cable terminals, so that the connector does not come out of the opening, shaft, etc.

Additional objects, advantages and features of embodiments of the present connector disclosed herein will become apparent to those skilled in the art upon examination of the description, or may be learned by practice thereof.

BRIEF DESCRIPTION OF THE DRAWINGS

Particular embodiments of the present connector will be described in the following by way of non-limiting examples, with reference to the appended drawings, in which.

DETAILED DESCRIPTION OF EMBODIMENTS

Figure 1:
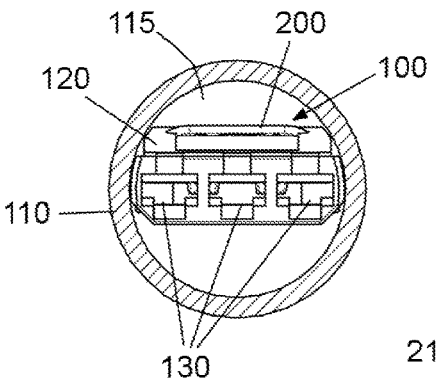
FIG. 1 is a cross-sectional view of one embodiment of the present connector fitted inside a hollow shaft.

In the example shown in the FIGS. 1-5 of the drawings there is an automotive electrical wiring connector for use, for example, in an electric rear mirror mechanism. The wiring connector 100 is suitable for being inserted through a standard 16 mm inner diameter hollow shaft 110, as described below.

The connector 100 comprises a body 120 having standard dimensions, such as for example a 19.2 mm width. The body 120 has three receiving portions 130 for receiving corresponding electrical conductor ends of respective cables (not shown in the drawings) to be connected to corresponding electrical conductor ends of other cables.

The body 120 of the connector 100 comprises a lid 140 that is hinged to the body 120. The lid 140 is sized for covering the electrical conductor receiving portions 130 and it comprises an inner retaining portion 150 for each receiving portion 130. In the embodiment shown, the lid 140 has three inner retaining portions 150. The inner retaining portions 150 protrude inwards towards each conductor receiving portion 130. In addition, the lid 140 includes a pair of flanges 160 adapted to be coupled to a coupling portion 170 of the connector body 120. Each flange 160 has a hollow portion 180 for receiving a projection 190 formed in one end of the coupling portion 170 for retaining the lid.

The lid 140 can be thus arranged in an operating position as shown in FIG. 1 of the drawings, where it is closed to the body 120 so that is can be passed through the interior 115 of the hollow shaft 110. In this lid operating position, the lid retains the electrical conductors inside the conductor receiving portions 130 through the inner retaining portions 150. As the lid 140 is also provided with an outer retaining portion 200 protruding outwards, it retains the connector body 120 when in said lid operating position as shown in FIG. 1, to prevent the connector from being moved relative to the shaft 110.

The lid 140 can be also arranged in a non-operating position as shown in FIGS. 2-5. In such non-operating position, the lid 140 is open so that it allows the electrical conductors to be accessed and released from the receiving portions 130.

Figure 3:
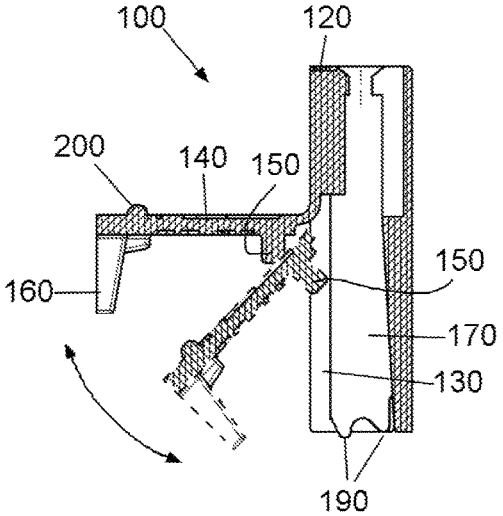
FIG. 3 is sectional view of the connector shown in FIGS. 1 and 2 along line AA in FIG. 2.

As shown in FIG. 3 through dashed lines, the lid 140 can be also arranged in an intermediate position (dashed lines) where the lid 140 protrudes from the connector body 120. In this lid intermediate position, the lid 140 retains the electrical conductors in the corresponding receiving portions 130 and, in turn, the lid 140 flexes when the connector passes through the interior 115 of the shaft 110.

Selective coupling of projections 190 of the coupling portion 170 into the corresponding hollow portion 180 of the flanges 160 allows the lid 140 to be arranged either in the intermediate position or the non-operating position.

Figure 2:
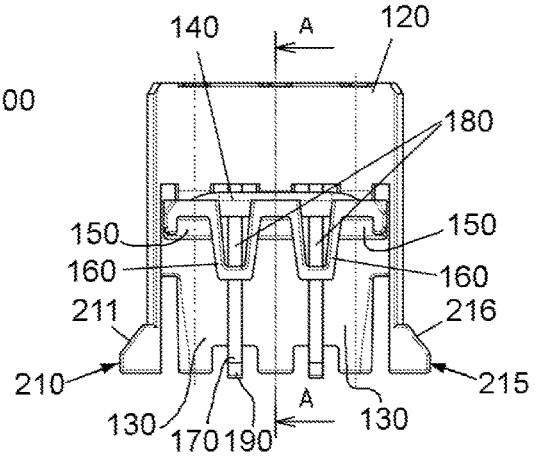
FIG. 2 is an elevational view of the embodiment of the connector in FIG. 1 shown with a lid in a non-operating position.
Figure 4:
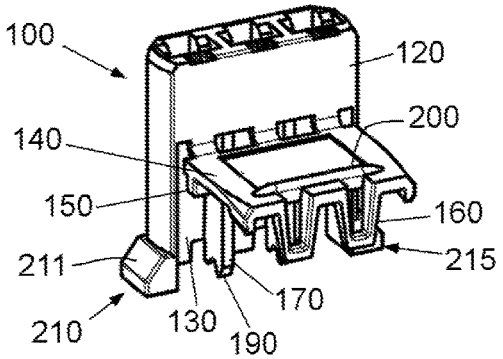
FIGS. 4 and 5 are different perspective views of the connectors shown in FIGS. 1-3, shown with the lid in the non-operating position.
Figure 5:
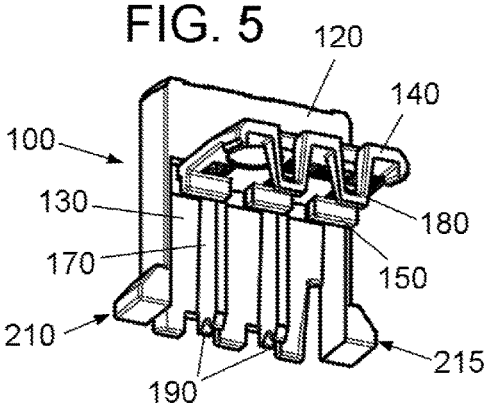

As shown in FIGS. 2 and 4-5 of the drawings, the connector body 120 also comprises two lateral elastic legs 210, 215 arranged at opposite sides of the body 120. The lateral elastic legs 210, 215 have an inclined portion 211, 216 for facilitating insertion of the connector body 120 through the interior 115 of the shaft 110.

Although only a number of particular embodiments and examples of the present wiring connector have been disclosed herein, it will be understood by those skilled in the art that other alternative embodiments and/or uses and obvious modifications and equivalents thereof are possible. Furthermore, the present disclosure covers all possible combinations of the particular embodiments described. Reference signs related to drawings and placed in parentheses in a claim, are solely for attempting to increase the intelligibility of the claim, and shall not be construed as limiting the scope of the claim. Thus, the scope of the present disclosure should not be limited by particular embodiments, but should be determined only by a fair reading of the claims that follow.

The invention claimed is:

1. An automotive electrical wiring connector for insertion through an interior of a hollow shaft, comprising:

a connector body having at least one electrical conductor receiving portion adapted for being connected to at least one electrical conductor, wherein the connector body comprises a lid for covering the electrical conductor receiving portion, the lid having at least one operating position wherein the lid is arranged to close the connector body and retain the at least one electrical conductor therein while retaining the connector body in the interior of the hollow shaft, and the lid having at least one non-operating position wherein the lid is open for allowing the at least one electrical conductor to be accessed and released, and the lid further having at least one intermediate position wherein the lid protrudes outward from the connector body while retaining the at least one electrical conductor therein and the lid flexes when the connector with the lid in the intermediate position passes through the interior of the hollow shaft, wherein the lid includes an inner retaining portion protruding inward towards each conductor receiving portion for retaining the at least one electrical conductor when the lid is in either the lid operating position or the lid intermediate position, and wherein the lid includes at least one flange adapted to be coupled to a coupling portion of the connector body in order to retain the lid in the operating position, wherein the flange and the inner retaining portion are separated from each other by a distance.

2. The connector as claimed in claim 1, wherein the connector body further comprises at least one lateral elastic leg having an inclined portion suitable for facilitating insertion of the connector body into the interior of the hollow shaft.

3. The connector as claimed in claim 2, wherein the connector body further comprises two lateral elastic legs arranged at opposite sides of the connector body.

4. The connector as claimed in claim 1, wherein the lid includes at least one flange adapted to be coupled to a coupling portion of the connector body in order to retain the lid in the intermediate position.

5. The connector as claimed in claim 1 wherein the coupling portion comprises the connector body provided with at least two projections projecting outwards into at least one corresponding hollow portion formed in the flange for defining, respectively, the lid operating and intermediate positions.

6. The connector as claimed in claim 1, wherein the lid includes an outer retaining portion protruding outwards therefrom for retaining the connector body in the shaft and maintaining the lid in at least one of the lid operating position and the lid intermediate position.

7. The connector as claimed in claim 1, wherein the lid is hinged to the connector body.

* * * * *